United States Patent [19]

Fujiwara et al.

[11] 4,188,212

[45] Feb. 12, 1980

[54] ELECTRIC CURRENT CONDUCTING COMPOSITION, IMAGE RECORDING ELEMENT CONTAINING THE SAME AND PROCESS FOR RECORDING IMAGES USING THE SAME

[75] Inventors: Maseto Fujiwara; Mitsuharu Nirasawa; Keiji Takeda, all of Saitama, Japan

[73] Assignee: Fuji Photo Film Co., Ltd., Japan

[21] Appl. No.: 825,114

[22] Filed: Aug. 16, 1977

[30] Foreign Application Priority Data

Aug. 18, 1976 [JP] Japan ..... 51-98533

[51] Int. Cl.[2] ..... G03G 5/04; G03G 13/22

[52] U.S. Cl. ..... 430/69; 346/135.1; 204/2; 204/18.1; 250/315.1; 250/316.1; 252/518; 430/97; 430/353

[58] Field of Search ..... 96/1 R, 1.5, 67, 88, 96/114, 48 HD; 204/2, 18 PC; 250/315 R, 316; 252/518; 346/135; 427/12, 56; 428/913

[56] References Cited

U.S. PATENT DOCUMENTS

| | | | |
|---|---|---|---|
| 2,910,377 | 10/1959 | Owen | 96/114.1 |
| 3,152,903 | 10/1964 | Shepard et al. | 204/2 |
| 3,212,890 | 10/1965 | Kimble et al. | 96/19 |
| 3,429,706 | 2/1969 | Shepard et al. | 96/48 HD |
| 3,672,904 | 6/1972 | de Mauriac | 96/114.1 |
| 3,859,094 | 1/1975 | Frarer et al. | 96/67 |

FOREIGN PATENT DOCUMENTS

| | | | |
|---|---|---|---|
| 51-63621 | 6/1976 | Japan | 204/2 |

*Primary Examiner*—Won H. Louie, Jr.
*Attorney, Agent, or Firm*—Sughrue, Rothwell, Mion, Zinn and Macpeak

[57] ABSTRACT

An electric current conductive composition comprising benzotriazole or a derivative thereof and a substantially electrically insulating binder, which is an essential component of an image recording element. The image recording element comprises a support having thereon a layer of the electric current conductive composition further containing a reducible metal compound, preferably an organic silver salt, a reducing agent, and having on different sides thereof an electrically conductive layer, with at least one of the electrically conductive layers being capable of transmitting actinic radiation. Image recording is accomplished by passing in the image recording element an image-wise pattern of an electric current sufficient to produce therein a storable latent image, followed by heating at least the electric current conductive composition layer to produce a visible image at the areas where the electric current passed through the electric current conductive composition.

55 Claims, 4 Drawing Figures

ELECTRIC CURRENT CONDUCTIVE COMPOSITION, IMAGE RECORDING ELEMENT CONTAINING THE SAME AND PROCESS FOR RECORDING IMAGES USING THE SAME

BACKGROUND OF THE INVENTION

1. Field of the Invention

The present invention relates to an electric current conductive composition and to a process for recording an image by passing an electric current using the electric current conductive composition. More particularly, the present invention relates to an electric current conductive composition comprising a substantially electrically insulating binder containing therein at least one of benzotriazole or a benzotriazole derivative, and, to an image recording process which comprises passing an image-wise pattern of an electric current in an image recording element comprising a support having thereon a layer of the electric current conductive composition, as an image recording layer, comprising a substantially electrically insulating binder containing therein at least one of benzotriazole or a benzotriazole derivative and a reducible metal compound wherein latent images are formed in the above-described image recording layer, and then dry processing the element to produce a visual image.

2. Description of the Prior Art

In recent years, a large amount of research has been directed toward the development of new compositions for image recording by passing an electric current through an image recording composition as well as on image recording processes, and toward improvements thereof.

It is known that images can be formed in certain recording materials by passing an electric current therethrough and various investigations have been made in this regard. For instance, a report thereon is described in K. S. Lion et al., "Investigation in the Field of Image Intensification, Final Report", *Air Force Cambridge Research Laboratories AFCRL*, pages 64–133 (1964), Contract No. AF 19(605)-5704. This process uses a conventional light-sensitive photographic emulsion which is positioned adjacent a photoconductive layer. While this process offers advantages in the form of increased sensitivity, it possesses the disadvantages, associated with the use of a conventional photographic emulsion, that wet processing is required.

Another approach to the production of visible images is disclosed in U.S. Pat. No. 3,138,547. This process involves electrically reducing a light-insensitive electric charge sensitive layer, wherein a specific metal compound in a dry state is reduced by passing an electric current therethrough to produce an image. A drawback of the recording process described in U.S. Pat. No. 3,138,547 is that no amplification is possible with this image recording system.

Still another recording technique is disclosed in U.S. Pat. Nos. 2,798,959 and 2,798,960. This technique involves heating a photoconductive material by passing an electric current therethrough to color a heat sensitive material which is positioned adjacent the photoconductive material. In this case, amplification is also difficult.

An image recording process which incorporates an amplification system is disclosed in U.S. Pat. No. 3,425,916. According to this process, physically developable nuclei (which may not be rendered visible) are formed through a relatively minute current flow which is generated by a photoconductor, and physical development is subsequently conducted in a processing solution. However, this process requires a wet processing and additionally requires a fixing.

Therefore, it is extremely preferred for latent images to be formed in a specific layer by passing an imagewise pattern of a relatively minute current flow in the specific layer and for these latent images to be then amplified by dry processing to produce a visual image.

One of the preferred techniques mentioned above is disclosed in Japanese Patent Application (OPI) No. 63621/76 (which corresponds to U.S. patent application Ser. No. 492,814, filed July 29, 1974). This process involves passing an image-wise pattern of electric charges through a heat developable light-sensitive material in a strong electric field to produce a latent image and then uniformly heating the light-sensitive material to produce a visual image. This process, however, requires a voltage of several kilovolts in order to pass electric charges through the substantially electrically insulating image forming layer, and further requires electric charge exposure for forming the latent image.

SUMMARY OF THE INVENTION

The present invention is basically different from the processes described above and comprises passing an electric current in an image-wise pattern, using an image recording layer comprising a substantially electric current conductive composition for image recording (hereafter, for brevity, often referred to as an electric current conductive composition), through the image recording layer to thereby produce a latent image, and then heating the image recording layer to produce a visual image. Therefore, the use of the electrically conductive recording layer makes it possible to use a voltage of only several volts in the present ivention. Even less than 1 volt is sufficient on some occasions. Image recording can, of course, be performed even using a voltage higher than that described above. In addition, exposure to an electric charge is not required.

An object of the present invention is to eliminate the drawbacks of the above-described conventional processes.

Another object of the present invention is to provide an image forming composition capable of image recording at a low voltage and an electric current conductive image recording element using the image forming composition.

Still another object of the present invention is to provide an image forming composition capable of being developed by heating along and, therefore, capable of being dry processed in general, and an electric current conductive image recording element using the image forming composition.

A still further object of the present invention is to provide a per se light-insensitive image forming composition and an electric current conductive image recording element using the same.

Accordingly, the present invention provides in one embodiment an electric current conductive composition consisting of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms in a substantially electrically insulating binder (a binder having an electric resistance of greater than about $10^{14}\Omega\cdot cm$).

This invention also provides an electric current conductive composition consisting essentially of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, a substantially electrically insulating binder and a reducible metal compound.

In a further embodiment of this invention, this invention provides an electric current conductive composition for a recording material consisting essentially of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, a substantially electrically insulating binder, a reducible metal compound and a reducing agent for the reducible metal compound.

In another embodiment of this invention, this invention provides an image recording element comprising a layer of the electric current conductive composition for a recording material described above and an electrically conductive layer.

In a still further embodiment of this invention, this invention provides an image recording element comprising a first electrically conductive layer, a layer of the electric current conductive composition for a recording material described above, a photoconductive material layer and a second electrically conductive layer in this order, with at least one of the electrically conductive layers being transparent to actinic radiation.

In an even further embodimentof this invention, this invention provides a process for producing an image by passing an electric current through an image recording element comprising a layer of an electric current conductive composition for a recording material consisting essentially of at least one member from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, a substantially electrically insulating binder, a reducible metal compound and a reducing agent for the metal compound and an electrically conductive layer, with the process comprising:

(i) producing an image-wise distribution of an electric current in the layer of the electric current conductive composition, and (ii) heating at least the layer of the electric current conductive composition to produce a visible image at the areas where the electric current passed through the layer of the electric current conductive composition.

In a still further embodiment of the present invention, the present invention provides a process for recording an image by passing an electric current through an image recording element comprising a first electrically conductive layer, a layer of an electric current conductive composition consisting essentially of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, a substantially electrically insulating binder, a reducible metal compound and a reducing agent for the reducible compound, a photoconductive material layer and a second electrically conductive layer, in this order, with at least one of the electrically conductive layers being transparent to actinic radiation, the process comprising:

(i) image-wise irradiating the photoconductive material layer using acitnic radiation through the electrically conductive layer transparent to actinic radiation while simultaneously applying a voltage to the two electrically conductive layers to pass an electric current through the layer of the electric current conductive composition, and (ii) heating at least the layer of the electric current conductive composition to produce a visible image at the areas where the electric current passed through the layer of the electric current conductive composition.

As described above, in the electric current conductive composition, at least one member selected from the group consisting of benzotriazole, nitrobenzotriazole, an alkylbenzotriazole in which the alky moiety thereof has up to about 20 carbon atoms, a halobenzotriazole and an amidobenzotriazole in which the amido moiety thereof has up to about 20 carbon atoms is employed. For the purposes of simplicity hereinafter, these compounds will be described as "benzotriazole or a derivative thereof".

Figure 1A:
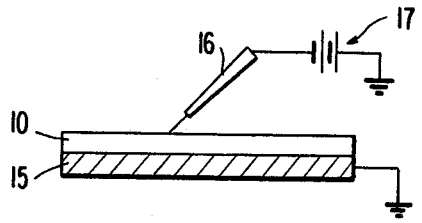
FIG. 1*a* and FIG. 1*b* are outlines of one embodiment of the process for recording an image in accordance with the present invention.

In the figures, the reference numbers designate the following elements: 10, an image recording layer; 15, 35, support plates; 16, a metal stylus; 17, 40, sources of electric current; 20, a metal plate; 30, a photoconductive material layer element; and 42, a switch.

DETAILED DESCRIPTION OF THE INVENTION

The term "heating" as used herein means a substantially uniform overall heating of the element using a heating means without adding any chemical compound or element thereto, or a heating in which a part of the recording element is heated using a heating means, that is, heat development. Such heating can be conducted in a dry state from the beginning to the end, and, in some cases, it can be also conducted by immersing the image recording element in a heated substantially inert liquid or liquid mixture, or by employing embodiments such as coating or spraying a heated liquid or liquid mixture as described above onto the image recording element, or the like.

The term "latent image" as used herein refers to a non-visible image or a weakly visible image which can be intensified in a subsequent heating step.

The present invention is advantageous in that the image forming step as well as the developing step can be a dry type; image recording can be accomplished with a low voltage of about 0.5 to about 500 V, preferably 1 to 100 V. A further advantage of the present invention is that it is possible to treat the image recording layer under normal room illumination except at the time when an electric current is applied thereto.

The process in accordance with the present invention is an all purpose type and, in addition, simple. For instance, various types of equipment can be employed in order to control the flow of an electric current in image recording elements. In greater detail, such equipment includes, e.g., as disclosed in Japanese Patent Application (OPI) No. 63621/76 (corresponding to U.S. patent application Ser. No. 492,814, filed July 29, 1974) devices such as a stencil, needle or screen which is electrically charged, or a suitable photoconductive material layer, i.e., a photoconductive layer adjacent an image forming layer. For controlling the electric current, a photoconductor is particularly advantageous. This is because a photoconductor is an element of a photoelectric sensor. It is particularly preferred for a photoelectric sensor layer to be used as a layer of a photoconductor. Therefore, various types of exposure devices can be used by selecting suitable photoconductors. Examples of types of exposure devices which can be used include a tungsten lamp, a xenon lamp, a helium-neon laser beam, and ultraviolet light, all of which include electromagnetic waves of a wavelength less than about 700 nm, and X-rays. Any source of actinic radiation can be used as a light source for exposure as long as the photoconductors are sensitive to the actinic radiation which is generated by the light source.

The present invention is based on the following. When a specific resistance was measured by coating polyvinyl butyral, which was generally believed to be electrically insulating, onto a polyester support having thereon an electrically conductive layer of indium (III) oxide, the value was greater than about $10^{14}\Omega\cdot$cm at room temperature (about 25° C.). On the other hand, when benzotriazole (the specific resistance of benzotriazole is about $1\times10^{9}\Omega\cdot$cm at 25° C.) of a weight equal to that of the polyvinyl butyral polymer was dispersed in the polyvinyl butyral polymer and the specific resistance thereof was similarly measured, the value was surprisingly reduced to about $10^{10}\Omega\cdot$cm at about 25° C. Why such a phenomenon happens is not yet completely clear and it was an unpredictable phenomenon. There was found, however, the possibility that an electric current could be uniformly passed through a binder which was generally electrically insulating, and thus the present invention has been accomplished. In addition, another characteristic of the present invention should be emphasized, that is, benzotriazole or benzotriazole derivatives melt upon heating since they have melting points around 100° C. so that they more easily facilitate the transfer of materials such as metal compounds (or metal salts) or metal ions, reducing agents, and color toning agents, etc., and thereby assist the precipitation of metals onto latent images.

While the mechanism of how latent images are formed in the image recording layer used in the present invention is not yet completely clear at this point in time, and while not desiring to be bound, it is conceivable that metal ions could be directly reduced by electrons on passing an electric current, or metal ions could be reduced by a chemical reaction with other charged carriers, etc.

According to the present invention, various image recording materials are effective. The optimum image recording materials are selected based on factors, for example, such as the type of image desired, the processing conditions required, the sensitivity of materials to an electric current, etc.

The heat developable image recording element which is effective in the present invention comprises an electrically conductive support (or a support optionally having coated or evaporated thereon an electrically conductive layer) having provided thereon at least one electric current conductive composition layer, and the electric current conductive composition comprises, at least, (i) a reducible metal compound (or a metal salt), (ii) a reducing agent which is capable of reducing the reducible metal compound (or the metal salt), (iii) benzotriazole or a benzotriazole derivative, and (iv) a substantially electrically insulating binder.

A number of reducible metal compounds are effective in the above-described image recording element. A representative example of such a reducible metal compound is an organic silver salt. Such an organic silver salt is a colorless, white or slightly colored silver salt, which reacts with a reducing agent to form silver (a silver image) when heated to not less than about 80° C., preferably not less than 100° C., in the presence of latent images formed by passing an electric current therethrough.

Organic silver salts which can be employed in accordance with the present invention are nitrogen-containing heterocyclic compounds which are capable of forming silver salts (or silver-nitrogen bonds) and silver salts of organic compounds containing a mercapto group, a thione group or a carboxyl group. Specific examples of these silver salts of organic compounds include the following:

(1) Silver salts of nitrogen-containing heterocyclic compounds which are capable of forming silver salts:

For example, silver benzotriazole, silver nitrobenzotriazole, silver alkyl-substituted benzotriazoles (e.g., methylbenzotriazole, etc.), silver halogen-substituted benzotriazoles (e.g., silver bromobenzotriazole, silver chlorobenzotriazole, etc.), silver substituted benzotriazoles (e.g.,

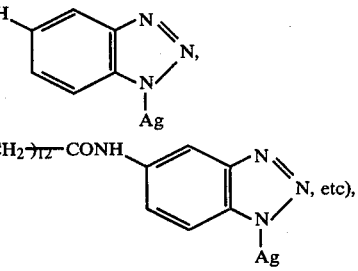

silver benzimidazole, silver substituted benzimidazoles (e.g., silver 5-chlorobenzimidazole, silver 5-nitrobenzimidazole, etc.), the silver salt of dipicrylamine, silver carbazole, silver saccharin, silver phthalazinone, silver substituted phthalazinones, silver phthalimide, silver pyrrolidone, silver tetrazole, silver salt imidazole, silver N-(benzoic acid-sulfonic acid-(2)-imides) (e.g., silver N-(benzoic acid-sulfonic acid-(2)-imide), silver N-(4-nitrobenzoic acid-sulfonic acid-(2)-imide), silver N-(5-nitrobenzoic acid-sulfonic acid-(2)-imide), etc.), and the like.

(2) Silver salts of mercapto group- or thione group-containing compounds:

For example, silver S-alkyl-thioglycolates wherein the alkyl substituent has 12 to 22 carbon atoms, as disclosed in Japanese Patent Application (OPI) 28221/73 (corresponding to U.S. Pat. No. 3,933,507 and to German Patent (DT-OS) No. 2,140,462); silver 2-alkylthio-5-(carboxylatomethylthio)-1,3,4-thiadiazoles, most preferably those wherein the alkyl group has from 12 to 22 carbon atoms, or silver 3-(carboxylatomethylthio)-1,2,4-triazoles; silver salts of thione compounds as disclosed in U.S. Pat. No. 3,785,830 (wherein the thione compounds are represented by the following general formula:

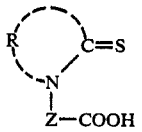

wherein R represents the atomic group necessary to complete a 5-membered heterocyclic ring, such as a thiazoline ring and an imidazoline ring, and Z represents an alkylene group containing 1 to 10 carbon atoms); silver S-2-aminophenylthiosulfates as disclosed in U.S. Pat. No. 3,549,379; silver 2-mercaptobenzoxazole, silver mercaptoxazole, silver 2-mercaptobenzothiazole, silver 2-(S-ethylthioglycolamido)-benzothiazole, silver 2-mercaptobenzimidazole, silver 3-mercapto-4-phenyl-1,2,4-triazole, silver mercaptotriazines, silver 2-mercapto-5-aminothiadiazole, silver 1-phenyl-5-mercaptotetrazole, silver dithiocarboxylates such as silver dithioacetate, silver thioamides, silver thiopyridines such as silver 5-ethoxycarbonyl-1-methyl-2-phenyl-4-thiopyridine, silver dithiodihydroxybenzole, silver diethyldithiocarbamate, etc.

(3) Carboxy group-containing organic silver salts:

For example, (a) silver salts of aliphatic carboxylic acids; e.g., silver caprate, silver laurate, silver myristate, silver palmitate, silver stearate, silver behenate, silver maleate, silver fumarate, silver tartarate, silver furoinate, silver linolate, silver oleate, silver hydroxystearate, silver adipate, silver sebacate, silver succinate, silver acetate, silver butyrate, silver camphorate, silver undecylenate, silver lignocerate, silver arachidonate, silver erucinate, silver oxalate, silver 10,12,14-octadecatrienoate, silver salts of thioether group-containing aliphatic carboxylic acids as disclosed in, for example, U.S. Pat. No. 3,330,663; silver propionate, silver valerate, silver caproate, silver caprylate, silver t-butylhydroperoxide, silver malonate, silver glutarate, silver pimelate, silver azelate, silver chloroacetate, silver trichloroacetate, silver fluoroacetate, silver iodoacetate, silver sarcosinate, silver aniline acetate, silver mandelate, silver hippurate, silver naphthalene acetate, silver creatinate, silver lactate, silver α- or β-mercaptopropionate, silver levulinate, silver salts of amino acids such as L-alanine, γ-amino lactic acid, ε-aminocapronic acid, L-aspartic acid, L-glutamic acid, L-leucine, etc., silver tricarballylate, silver nitrilotriacetate, silver citrate, silver ethylenediaminetetraacetate, silver acrylate, silver methacrylate, silver crotonate, silver sorbate, silver itaconate, etc.; (b) silver salts of aromatic carboxylic acids; e.g., silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, silver 4'-octadecyloxybiphenyl-4-carboxylate, silver m-nitrobenzoate, silver o-aminobenzoate, silver furoinate, silver p-hexyloxybenzoate, silver octadecyloxybenzoate, silver cinnamate, silver p-methoxycinnamate, silver furoate, silver p-nitrophenyl acetate, silver nicotinate, silver isonicotinate, silver picolinate, silver pyridine-2,3-dicarboxylate, etc.

(4) Silver sulfonates:

For example, silver ethane sulfonate, silver 1-propane sulfonate, silver 1-butane sulfonate, silver 1-pentane sulfonate, silver allyl sulfonate, silver benzene sulfonate, silver 1-n-butylnaphthalene-4-sulfonate, silver naphthalene-1,5-disulfonate, silver α- or β-naphthalene sulfonate, silver p-toluene sulfonate, silver toluene-3,4-disulfonate, silver diphenylamine sulfonate, silver 2-naphthol-3,6-disulfonate, silver anthraquinone-β-sulfonate, silver 2-amino-8-naphthol-6-sulfonate, silver p-vinylbenzenesulfonate, etc.

(5) Silver sulfinates:

For example, silver p-toluene sulfinate, silver p-acetaminobenzene sulfinate, silver benzene sulfinate, etc.

(6) Silver organic phosphates:

For example, silver phenyl phosphate, silver p-nitrophenyl phosphate, silver β-glycerophosphate, silver 1-naphthyl phosphate, silver adenosine-5'-3-phosphate, etc.

(7) Silver salts of macromolecular compounds:

For example, silver polyacrylate, silver polyvinyl hydrogen phthalate, silver polystyrene sulfonate, etc.

(8) Other silver salts:

For example, silver 4-hydroxy-6-methyl-1,3,3a,7-tetrazaindene, silver 5-methyl-7-hydroxy-1,2,3,4,6-pentazaindene, silver tetrazaindenes as disclosed in British Pat. No. 1,346,595; silver 5-nitrosalicylaldoxime, silver 5-chlorosalicylaldoxime, the silver salt of barbituric acid, silver picrate, silver rosinate, the silver salt of pyridine, the silver complex of cyclopentadiene, the silver complex of pyridine, the silver complex of cyclopentapolyene, the silver complex of N-vinylcarbazole, the silver salt of o-sulfobenzimide, etc.

In addition, oxidizing agents such as titanium dioxide, zinc oxide, gold salts of carboxylic acids, e.g., gold laurate, gold stearate, gold behenate, etc., can be optionally employed together with the above-described silver salts.

Of the above-described organic silver salts, comparatively light stable organic silver salts are suitable. Silver salts of long chain aliphatic carboxylic acids containing 10 or more carbon atoms such as silver laurate, silver myristate, silver palmitate, silver stearate and silver behenate are particularly preferred. The silver salt of benzotriazole is likewise preferred. In particular, the specific resistance of the electric current conductive composition can be reduced by the incorporation of the silver salt of benzotriazole therein. In addition, mixtures of the organic silver salts described above can also be used as the organic silver salts in accordance with the present invention.

Examples of useful metal compounds (or metal salts) which are not silver salts include copper benzotriazole, copper stearate, nickel behenate, lead behenate and the like.

A suitable average particle size for the reducible metal salts employed is about 0.01 μm to about 10 μm, preferably 0.1 μm to 5 μm. Generally speaking, the smaller the particle size of the reducible metal salt, the better the sensitivity to electric current.

A variety of reducing agents for the reducible metal compounds (or metal salts) are useful in the previously described image recording elements. Suitable reducing agents which can be used in accordance with the present invention are those capable of reducing metal compounds (or metal salts) when heated preferably in the presence of latent image nuclei. Of these reducing agents, the reducing agent actually used is dependent upon the kind and property of the metal compound (or metal salt) used. Specific examples which can be used in accordance with the present invention are as follows.

(1) Substituted phenols:

For example, aminophenols; e.g., 2,4-diaminophenol, methylaminophenol, p-aminophenol, o-aminophenol, 2-methoxy-4-aminophenol, 2-β-hydroxyethyl-4-aminophenol, 4-amino-2,6-dibromophenol, 4-amino-2-methylphenol sulfate, 4-amino-3-methylphenol sulfate, 4-amino-2,6-diiodophenol, 4-amino-2,6-dichlorophenol hydrochloride, N-methyl-p-aminophenol sulfate, 4-benzylideneaminophenol, 4-isopropylideneaminophenol, 2,4-diamino-6-methylphenol, a 2-acylaminophenol which contains an acyl group having 2 to 18 carbon atoms, N-(4-hydroxyphenyl)-aminoacetic acid ethyl 4-hydroxyphenyl carbamate, 6-dimethylamino-3-hydroxytoluene, an N-(4-hydroxyphenyl)-N'-alkyl urea which contains an alkyl group having 1 to 18 carbon atoms (such as N-(4-hydroxy-3,5-di-t-butylphenyl)-N'-octadecyl urea, N-(4-hydroxy-3,5-dichlorophenyl)-N'-octadecyl urea), 3-chloro-4-hydroxydiphenylamine, 4-(4-hydroxybenzylideneamino)-2-methylphenol, 4-(4-hydroxybenzylideneamino)-3-methylphenol, 4-(3-hydroxybenzylideneamino)phenol, α,α'-bis(4-hydroxyphenylamino)-p-xylene, 4-benzylideneamino-2-methylphenol, 4-(2-hydroxybenzylideneamino)phenol, α,α'-bis(4-hydroxy-3-methylphenylimino)-p-xylene, a 2-acylaminophenol which contains an acyl group having 1 to 18 carbon atoms, an N-(2-hydroxyphenyl)-N'-alkyl urea which contains an alkyl group having 1 to 18 carbon atoms, 6-aminophenol sulfonic acid-(3)-amide, 6-aminophenol sulfonic acid-(3)-dimethylamide, 2-aminophenol sulfonic acid-(4)-amide, 2-benzylideneaminophenol, 4-(4-hydroxybenzylideneamino)phenol, α,α'-bis(2-hydroxyphenylamino)-p-xylene, 3-(2-hydroxyphenylhydrazono)-2-oxo-oxolane, 3-(4-hydroxyphenylhydrazono)-2-oxo-oxolane, 4-hydroxyanilinomethane sulfonic acid, 4-hydroxy-3-methylanilinomethane sulfonic acid, etc.; alkyl substituted phenols, e.g., p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, 2,4,6-tri-t-butylphenol, 2,6-di-t-butyl-4-octylphenol, 2,6-di-t-butyl-4-ethylphenol, 2,4,6-tri-t-amylphenol, 2,6-di-t-butylphenol, 2-isopropyl-p-cresol, 3-methyl-3-(3-methyl-4-hydroxyphenyl)pentane, 2,6-di-t-butyl-4-nonylphenol, 2,4-di-t-butyl-6-nonylphenol, etc.; aryl substituted phenols, e.g., p-phenylphenol, o-phenylphenol, α-phenyl-o-cresol, etc.; other phenols, e.g., p-acetophenol, p-acetoacetylphenol, 1,4-dimethoxybenzene, 2,6-dimethoxyphenol, chlorothymol, 3,5-di-t-butyl-4-hydroxybenzyldimethylamine, 2,6-di-cyclohexyl-p-cresol, 2,6-di-t-butyl-4-methoxymethylphenol, 4-methoxyphenol, 2-methyl-4-methylmercaptophenol, 2,6-dicyclopentyl-p-cresol,2-t-butyl-6-cyclopentyl-p-cresol, 2-t-butyl-6-cyclohexyl-p-cresol, 2,5-dicyclopentyl-p-cresol, 2,5-dicyclohexyl-p-cresol, 2-cyclopentyl-4-t-butylphenol, 3,5-di-t-butyl-4-hydroxybenzophenone, 3,5-di-t-butyl-4-hydroxy cinnamic acid, 3,5-di-t-butyl-4-hydroxybenzaldehyde, ehtyl 3,5-di-t-butyl-4-hydroxycinnamate and the sulfonamide phenols as disclosed in U.S. Pat. No. 3,801,321; polyvinyl-(2-hydroxy-3-methoxybenzal); hydroxyindanes as disclosed in U.S. Pat. No. 3,887,378; hydroxycumarones and hydroxycumaranes as disclosed in U.S. Pat. No. 3,819,382; and novolak resin reaction products prepared from formaldehyde and phenol derivatives (e.g., 4-methoxyphenol, m-cresol, o- or p-t-butylphenol, 2,6-di-t-butylphenol and mixtures thereof).

(2) Substituted or unsubstituted bis, tris and tetrakisphenols:

For example, o-bisphenols (e.g., 1,1-bis(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)methane, bis(2-hydroxy-3-t-butyl-5-ethylphenyl)methane, 2,6-methylenebis(2-hydroxy-3-t-butyl-5-methylphenyl)-4-methylphenol, 1,1-bis(5-chloro-2-hydroxyphenyl)methane, 2,2'-methylenebis[methyl-6-(1-methylcyclohexyl)phenol], 1,1-bis(2-hydroxy-3,5-dimethylphenyl)-2-methylpropane, 1,1,5,5-tetrakis(2-hydroxy-3,5-dimethylphenyl)-2,4-ethylpentane, 3,3',5,5'-tetramethyl-6,6'-dihydroxytriphenylmethane, 1,1-bis(2-hydroxy-3,5-di-t-butylphenyl)pentane, 1,1-bis(2-hydroxy-3,5-di-t-butylphenyl)ethane, 1,1-bis(2-hydroxy-3,5-di-t-butylphenyl)-propane, 1,1-bis(2-hydroxy-3,5-di-t-butylphenyl)butane, 1,1-bis(2-hydroxy-3,5-di-t-amylphenyl)ethane, 1,1-bis(2-hydroxy-3-cyclohexyl-5-t-butylphenyl)methane, 1,1-bis-(2-hydroxy-3-cyclopentyl-5-t-butylphenyl)-2,2-dimethylethane, bis(2-hydroxy-3-cyclopentyl-5-methyl-6-cyclopentylphenyl)sulfide, 1,1-bis(2-hydroxy-3-cyclopentyl-5-t-butylphenyl)butane, 1,1-bis(2-hydroxy-3-cyclopentyl-5-t-butylphenyl)methane, 1,1-bis(2-hydroxy-3,5-di-cyclopentyl-6-methylphenyl)methane, 1,1-bis(2-hydroxy-3,6-di-cyclopentyl-5-methylphenyl)methane, bis(2-hydroxy-3-cyclopentyl-5t-butylphenyl) sulfide, bis(2-hydroxy-3-cyclohexyl-5-t-butylphenyl) sulfide, 1,1-bis-(2-hydroxy-3-t-butylphenyl)methane, p-cresol-acetaldehyde or formaldehyde novolak resins, bis(2-hydroxy-3-t-butyl-5-methylphenyl) sulfide, 1,1-bis(2-hydroxy-3,5-dimethylphenyl)methane, 1,1-bis(2-hydroxy-3,5-di-t-butylphenyl)-2-methylpropane, 1,2-bis(2-hydroxy-3-butyldibenzofuryl)ethane, and 3,3',5,5'-tetra-t-butyl-6,6'-dihydroxytriphenylmethane); p-bisphenols (e.g., bisphenol A, 4,4'-methylenebis(3-methyl-5-t-butylphenol), 4,4'-methylenebis(2,6-di-t-butylphenol), 3,3',5,5'-tetra-t-butyl-4,4'-dihydroxyphenyl, 4,4'-dihydroxybiphenyl, 1,1-bis(4-hydroxyphenyl)-cyclohexane,2,2-bis(3,5-dibromo-4-hydroxyphenyl)propane, 2,2-bis(3,5-dichloro-4-hydroxyphenyl)propane, 2,2-bis(3,5-dimethyl-4-hydroxyphenyl)propane, 2,2-bis(3-methyl-4-hydroxyphenyl)propane, bis(3-methyl-4-hydroxy-5-t-butylphenyl)sulfide, 2,2-bis(4-hydroxy-3,5-di-t-butylphenylthio)propane, 4,4'-butylidenebis(6-t-butyl-3-methylphenyl), 4,4'-thiobis(6-t-butyl-3-methylphenol), 4,4'-thiobis(6-t-butyl-2-methylphenol), 4,4'-butylidenebis(6-methylphenol), 4,4'-benzylidenebis(2-t-butylphenol), 4,4'-ethylidenebis(6-t-butyl-o-cresol), 4,4'-ethylidenebis(2-t-amylphenol), 4,4'-(p-chlorobenzylidene)-di(2,6-xylenol), 4,4'-ethylidenebis(2-cyclohexylphenol), 4,4'-pentylidene-di(o-cresol), 4,4'-(p-bromobenzylidene)diphenol, 4,4'-propylidenebis(2-phenylphenol), 4,4'-ethylidene-di(2,6-xylenol), 4,4'-heptylidene-di(o-cresol), 4,4'-ethylidene-bis(2,6-di-t-butylphenol), 4,4'-(2-butenylidene)-di(2,6-xylenol), 4,4'-(p-methylbenzylidene)-di(o-cresol), 2,2-bis(3-methyl-4-hydroxy-5-t-butylphenyl)propane, α,α'-(4-hydroxy-3,5-di-t-butylphenyl)dimethyl ether, 4,4'-dihydroxy-3,3',5,5'-tetra-t-butylbiphenyl, 4,4'-dihydroxy-3,3'-dimethylbiphenyl, 2,2-bis(3-methyl-4-hydroxy-5-t-butylphenyl)propane, 2,2bis(4-hydroxy-3,5-di-t-butylphenyl)propane, 2,2-bis(4-hydroxy-3,5-diethylphenyl)propane, 2,2-bis(4-hydroxy-3-methyl-5-t-amylphenyl)propane, 2,2-bis(4-hydroxy-3,5-di-t-amylphenyl)propane), polyphenols (e.g., 2,4,6-tris(3,5-di-t-butyl-4-hydroxybenzyl)phenol, N,N'-di(4-hydroxyphenyl) urea, tetrakis[methylene(3,5-di-t-butyl-4-hydroxyhydrocinnamato)methane], 3,5-di-t-butyl-4-hydroxybenzyldimethylamine, etc.), diethylstilbestrol, hexestrol, bis(3,5-di-t-butyl-4-hydroxybenzyl) ether, 2,6-bis(2'-hydroxy-3'-t-butyl-5'-methylbenzl)-4-methylphenol, etc.

(3) Substituted or unsubstituted mono- or bis-naphthols and di- or polyhydroxynaphthalenes:

For example, bis-β-naphthols (e.g., 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl, etc.); naphthols (e.g., α-naphthol, β-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, 1-amino-2-naphthol-6-sodium sulfonate, 1-naphthylamine-7-sulfonic acid, etc.), 2,3-dihydroxynaphthalene, 1-hydroxy-2-carboxynaphthalene, 1-hydroxy-4-methoxydihydronaphthalene, 2-hydroxy-3-carboxynaphthalene, 1-hydroxy-4-ethoxynaphthalene, 1-hydroxy-4-propoxynaphthalene, 1-hydroxy-4-isopropoxynaphthalene, 1-hydroxy-5-methoxynaphthalene, morpholino(1-hydroxy-4-methoxynaphthyl-(2))methane, sulfonamide naphthols as disclosed in U.S. Pat. No. 3,801,321; 2-hydroxy-3-aminonaphthalene and 1-hydroxy-5-acylaminonaphthalene which contain an acyl group having 1 to 18 carbon atoms; etc.

(4) Di- or polyhydroxybenzenes and hydroxymonoethers:

For example, hydroquinone, alkyl substituted hydroquinones (most preferably containing an alkyl group having 1 to 5 carbon atoms, e.g., methylhydroquinone, t-butylhydroquinone, 2,5-dimethylhydroquinone, 2,6-dimethylhydroquinone, t-octylhydroquinone, etc.), halogen substituted hydroquinones (e.g., chlorohydroquinone, dichlorohydroquinone, bromohydroquinone, etc.), alkoxy substituted hydroquinones (most preferably containing an alkoxy group having 1 to 5 carbon atoms, e.g., methoxyhydroquinone, ethoxyhydroquinone), other substituted hydroquinones (e.g., phenylhydroquinone, etc.), hydroquinone mono-sulfate, 2,5-dihydroxyalkyl (with alkyl moieties having 1 to 18 carbon atoms being preferred) hydroquinone, 2-ethoxycarbonylhydroquinone, acetylhydroquinone, 2-cyclohexylhydroquinone, (2,5-dihydroxyphenyl)-5-(1-phenyltetrazolyl)sulfide, (6-methyl-2,5-dihydroxyphenyl)-5-(phenyltetrazolyl)sulfide, (2,5-dihydroxyphenyl)-2-(benzothiazolyl)sulfide, 2-dodecyl-5-(5-carboxypentyl)-hydroquinone, 2-dodecyl-5-(9-carboxynonyl)hydroquinone, 2-tetradecyl-5-(5-carboxypentyl)hydroquinone, 2-tetradecyl-5-(9-carboxynonyl)hydroquinone, etc.; hydroquinone monoethers (e.g., p-methoxyphenol- or p-ethoxyphenol-hydroquinone monobenzyl ether, 2-t-butyl-4-methoxyphenol- or 2,5-di-t-butyl-4-methoxyphenol-hydroquinone mono-n-propyl ether, hydroquinone mono-n-hexyl ether, etc.) and others, e.g., catechol, 4-phenylcatechol, 3-(dihexylaminomethyl)-5-phenylcatechol, 3-(di-n-hexylaminomethyl)-5-phenylcatechol, 3-cyclohexylpyrocatechol, 4-cyclohexylpyrocatechol, 4-(α-methylbenzyl)pyrocatechol, dicyclohexylpyrocatechol, 5-(N,N-dihexylaminomethyl)-4-phenylcatechol, 4-lauroylcatechol, t-butylcatechol, pyrogallol, 4-azeloyl pyrogallol, 4-stearoyl pyrogallol, di-t-butylpyrogallol, 4-butyryl pyrogallol, 4-azeloyl bipyrogallol, phloroglucinol, resorcinol, 4,6-di-t-butylresorcinol, 4-alkyl resorcinols which contain an alkyl group having 1 to 18carbon atoms, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, 2,3-dihydroxybenzoic acid, 3,4-dihydroxybenzoic acid, 2,5-dihydroxybenzoic acid, o-aminobenzoic acid, m-aminobenzoic acid, p-aminobenzoic acid, protocatechic aldehyde, ethyl protocatechuate, cetyl protocatechuate, 4-(3',4'-dihydroxyphenylazo)benzoic acid, 3,4-dihydroxyphenylacetic acid, 1-acetyl-2,3,4-trihydroxybenzene, 2,2'-methylenebis(3,4,5-trihydroxyphenyl)benzoic acid, gallic acid, methyl gallate, propyl gallate, butyl gallate, sodium gallate, ammonium gallate, dodecyl gallate, ethyl gallate, isopropyl gallate, gallic anilide, 3,4,5-trihydroxyacetophenone, etc.; etc.

(5) Ascorbic acid and derivatives thereof:

For example, L-ascorbic acid, isoascorbic acid, ascorbic acid acid monoesters (e.g., the monolaurate, monomyristate, monopalmitate, monostearate, monobehenate, monobenzoate, 6-palmitate-5-β-carboxypropionate-6, etc., of ascorbic acid), diesters of ascorbic acid (e.g., the dilaurate, dimyristate, dipalmitate, distearate, etc., of ascorbic acid). Those ascorbic acids as described in U.S. Pat. No. 3,337,342 can also be used.

(6) 3-Pyrazolidones, pyrazolines and pyrazolones:

For example, 1-phenyl-3-pyrazolidone, 4-methyl-4-hydroxymethyl-1-phenyl-3-pyrazolidone, those described in British Pat. No. 930,572, 1-(2-quinolyl)-3-methyl-5-pyrazolone, etc.

(7) Reducing saccharides:

For example, glucose, lactose, etc.

(8) Phenylenediamines:

For example, o-phenylenediamine, p-phenylenediamine, N,N'-dimethyl-p-phenylenediamine, N,N'-diethyl-p-phenylenediamine, N-phenyl-N'-isopropyl-p-phenylenediamine, N,N'-dibenzylidene-p-phenylenediamine, N,N-diethyl-N'-sulfomethyl-p-phenylenediamine, N-benzylidene-N',N'-diethyl-p-phenylenediamine, N,N-dimethyl-N'-sulfomethyl-p-phenylenediamine, 3-methoxy-4-sulfomethylamino-N,N'-diethylaniline, N,N'-disulfomethyl-p-phenylenediamine, N-(2-hydroxybenzylidene)-N',N'-diethyl-p-phenylenediamine, N-(3-hydroxybenzylidene)-N',N'-diethyl-p-phenylenediamine, N-(4-hydroxybenzylidene)-N',N'-diethyl-p-phenylenediamine, N,N-diethyl-3-methyl-p-phenylenediamine, N,N-diethyl-p-phenylenediamine trifluoroacetate, hydroxyethylparamine and the like, which can provide color images by using them together with phenolic or active methylenic color couplers as disclosed in U.S. Pat. Nos. 3,531,286 and 3,764,328; and can also be used to obtain color images in accordance with the method as disclosed in U.S. Pat. No. 3,761,270.

(9) Hydroxyamines:

For example, hydroxyamines as disclosed in U.S. Pat. Nos. 3,667,958 and 3,933,506, etc.

(10) Reductones:

For example, aminohexose reductones, anhydroaminohexose reductones and anhydrodihydroaminohexose reductones, as disclosed in U.S. Pat.

No. 3,679,426; linear amino reductones as disclosed in Belgian Pat. No. 786,086; etc.

(11) Hydroxamic acids:

For example, hydroxamic acids as disclosed in U.S. Pat. Nos. 3,751,252 and 3,751,255; etc.

(12) Hydrazides:

For example, hydroxy substituted fatty acid arylhydrazides as disclosed in U.S. Pat. No. 3,782,949; etc.

(13) Others:

For example, indane-1,3-diones each of which contains at least one hydrogen atom at the 2-position as disclosed in U.S. Pat. No. 3,773,512; amidoximes as disclosed in U.S. Pat. No. 3,794,488; substituted hydropyridines as disclosed in U.S. Pat. No. 3,928,686; organic hydrazone compounds as disclosed in U.S. Pat. No. 3,615,533; hydrazines as disclosed in U.S. Pat. No. 3,667,958; amino-9,10-dihydroacridines; 1,4-dihydropyridines as disclosed in U.S. Pat. No. 3,839,048; acetoacetonitriles; homogentisic acid and homogentisamide; hydroxytetronic acids and hydroxytetronimide; kojic acid; hinokitiol; p-oxyphenylglycine; 4,4'-diaminodiphenyl; 4,4'-dimethylaminophenyl; 4,4',4''-diethylaminotriphenylmethane; spiroindane; and 4-methylaesculetin.

Of the above described reducing agents, phenols which contain an alkyl group, e.g., a methyl, ethyl, propyl, isopropyl or butyl group, or an acyl group at at least one position adjacent the position having a hydroxyl substituent in an aromatic nucleus, for example, 2,6 -di-t-butylphenol group containing mono-, bis-, tris- or tetrakis-phenols, have the characteristic of a slight color change under light exposure because they are stable to light. Moreover, as disclosed in U.S. Pat. No. 3,827,889, reducing agents capable of being deactivated by light exposure, such as photolytic reducing agents are well suited for use in the present invention because a reducing agent of this kind will be deactivated or decomposed by light when a photographic material containing such a reducing agent is allowed to stand under normal room illumination after development resulting in a cessation of reduction, and, therefore, a cessation of color changes. Specific examples of photolytic reducing agents include L-ascorbic acid and the derivatives thereof, furoin, benzon, dihydroxyacetone, glyceraldehyde, rhodisonic tetrahydroxyquinone, 4-methoxy-1-naphthol, aromatic polysulfide compounds as disclosed in Japanese Patent Application (OPI) No. 99719/75, and the like. Further, compounds capable of accelerating the photolysis of the reducing agent can additionally be employed, if desired.

Suitable examples of reducing agents of non-silver salts which can be employed in the present invention include sodium hypophosphite, hydrazine, sodium borohydride, sodium potassium tartrate and the like.

Suitable reducing agents are selected depending upon the kind (property) of the metal compounds (or metal salts) used. Of the above-described classes (1) to (13) of reducing agents, the strength as reducing agents can be basically described as (1 )<(2)<(3)<(4)<(5)<(6) to (13). A stronger reducing agent is suitable for silver salts which are comparatively difficult to reduce such as the silver benzotriazole, silver behenate, etc., whereas weaker ones are suitable for silver salts which are comparatively easy to reduce such as silver caprate, silver laurate, etc. Suitable reducing agents for the silver benzotriazole include 1-phenyl-3-pyrazolidones, ascorbic acid, ascorbic acid monocarboxylic acid esters, naphthols (e.g., 4-methoxy-1-naphthol, etc.), and the like. As the reducing agent for silver behenate, many compounds such as o-bisphenols of the bis(hydroxyphenyl)methane series, hydroquinone and the like can be used. Also, substituted tetrakisphenols, o-bisphenols of the bis(hydroxyphenyl)alkane series, p-bisphenols (e.g., a bisphenol A derivative), p-phenylphenols, and the like can be used as the reducing agent for silver caprate and silver laurate.

The amount of the reducing agent used in the present invention will vary depending upon the kind of metal compound (metal salt) or reducing agent and upon other additives, but, in general, a suitable amount ranges from about 0.05 mol to about 10 mols, preferably from about 0.1 to about 3 mols, per mol of the metal compound (or metal salt).

In the image recording element which is used in the process of the present invention, the most effective concentration of the reducible metal compound (or metal salt) contained therein will vary depending upon several factors, e.g., electric current sensitivity of the components present in the image recording layer, the images desired, the processing conditions used and the like.

As the compound which is added to render the composition in accordance with the present invention electric current conductive, benzotriazole or benzotriazole derivatives are preferred. Specific examples of the benzotriazole derivatives include nitrobenzotriazole; alkyl-substituted benzotriazoles in which the alkyl moiety thereof has up to about 20 carbon atoms, preferably 1 to 5 carbon atoms, e.g., methylbenzotriazole; halogen-substituted benzotriazoles, e.g., bromobenzotriazole, chlorbenzotriazole; amido substituted benzotriazoles in which the amido moiety thereof has up to about 20 carbon atoms, e.g.,

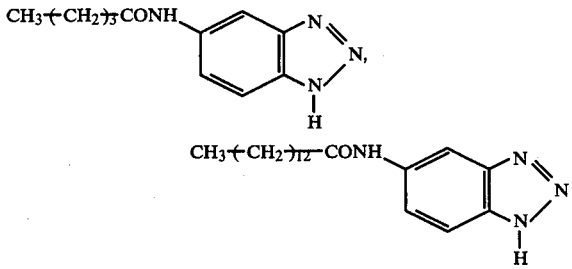

and the like.

Suitable benzotriazoles which can be used in this invention can be represented by the general formula:

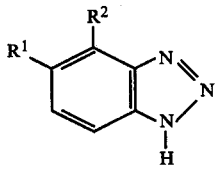

wherein $R^1$ and $R^2$, which may be the same or different, each represents a hydrogen atom, a straight or branched chain alkyl group having up to 20 carbon atoms, a halogen atom (e.g., fluorine, chlorine, bromine and iodine), a nitro group or an alkylamido group of the formula:

$R^3$—CO—NH— wherein $R^3$ is an alkyl group having up to 19 carbon atoms.

The amount of benzotriazole or benzotriazole derivatives present in the composition will vary depending on the voltage applied to the electric current conductive composition layer in the recording element used in the process of the present invention, the images desired, the processing conditions employed and the like, but, the benzotriazole or benzotriazole derivatives may be employed in a range from about 0.01 to about 30 parts by weight, preferably from 0.1 to 10 parts by weight, per part by weight of the binding agent (binder). Generally speaking, the larger the amount of the benzotriazole or derivatives thereof employed, the lower the specific resistance of the electric current conductive composition and the image recording layer. Moreover, the specific resistance is reduced further if the electric current conductive composition in accordance with the present invention is heated (temperatures at about 40° C. or more).

The specific resistance of the electric current conductive composition in accordance with the present invention in general ranges from about $10^9\Omega\cdot$cm to about $10^{13}$ $\Omega\cdot$cm at normal temperatures (about 10° to about 40° C.). More specifically, the specific resistance of the electric conductive composition of this invention consisting of at least one of benzotriazole and a benzotriazole derivative and a substantially electrically insulating binder is about $10^9\Omega\cdot$cm to about $10^{13}\Omega\cdot$cm and that of the electric current conductive composition for a recording material consisting essentially of at least one of benzotriazole and a benzotriazole derivative, a substantially electrically insulating binder, a reducible metal compound and a reducing agent for the metal compound is about $10^7\Omega\cdot$cm to about 10—$\Omega\cdot$cm. The minimum value of the specific resistance is determined by the amount of benzotriazole or derivatives thereof which can be present in the composition. If the weight ratio of the benzotriazole or derivatives thereof exceeds about 30 parts by weight per part by weight of the binder, the strength of the layer of the composition is insufficient. The maximum value of the specific resistance is the maximum specific resistance which is necessary for enabling an electric current to substantially pass through the composition of the present invention as well as the image recording layer used in the present invention, and it corresponds to the minimum amount of the benzotriazole or derivatives thereof in the above-described composition.

Furthermore, the specific resistance of the electric current conductive composition in accordance with the present invention can further be reduced, e.g., to about $1\times10^7\Omega\cdot$cm, by incorporating therein the previously described reducible metal compounds, particularly organic silver salts.

The above-described image recording element can include a variety of substantially electrically insulating binders, especially polymeric binders. Useful polymeric binders which can be employed can be either hydrophobic or hydrophilic, although hydrophilic binders are preferred. Examples include both naturally occurring materials such as proteins, for example, gelatin, gelatin derivatives, cellulose derivatives, polysaccharides such as dextran, gum arabic and the like; and synthetic polymeric materials such as water-soluble polyvinyl compounds like poly(vinylpyrrolidone), acrylamide polymers and the like. Other synthetic polymeric compounds which are useful include dispersed vinyl compounds. Effective polymers include water-insoluble polymers of alkyl acrylates and methacrylates, acrylic acid, sulfoalkylacrylates, methacrylates and those which have cross-linking sites which facilitate hardening or curing as well as those having recurring sulfobetaine units as described in Canadian Pat. No. 774,054. Especially useful polymers include polycarbonates, polyvinyl butyral, cellulose acetate butyrate, gelatin, gelatin derivatives, cellulose acetate, polymethyl acrylate, polymethyl methacrylate, polyvinyl pyrrolidone, ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid and polyvinyl alcohol. The selection of an optimum polymer as a binder for the above-described image recording element will depend on the particular image recording element, the particular reducible metal compound (or metal salt), the particular reducing agent, the processing conditions and the like. It is essential that the binder not adversely affect the desired properties of the image recording element. Useful polymeric binding agents are described in the hereinbefore mentioned patents describing useful reducible metal compounds (or metal salts).

The electric current conductive composition layer of the electric current conductive image recording element used in the process of the present invention can be positioned on a wide variety of supports. Representative examples of suitable supports include a cellulose nitrate film, a cellulose ester film (e.g., a cellulose diacetate film, a cellulose triacetate film, a cellulose acetate butyrate film, a cellulose acetate propionate film, etc.), a poly(vinyl acetal) film, a polystyrene film, a poly(ethylene terephthalate) film, a polycarbonate film or resinous materials, as well as glass, paper, metal and the like. However, if the support is composed of an electrically insulating material, the recording element must also include an electrically conductive layer positioned between the support and the above-described composition layer, as a part of the image recording element. A suitable thickness of the electric current conductive composition layer on the support is about 0.2 $\mu$m to about 30 $\mu$m, and a suitable amount of benzotriazole or a derivative thereof usually coated per unit area of the support is about 0.08 g/m$^2$ to about 12 g/m$^2$, preferably 0.4 g/m$^2$ to 4 g/m$^2$.

Layers of a wide variety of materials can be employed as the electrically conductive layer in the present invention. Such a layer can be considered to be electrically conductive if for obtaining an image having a size of $5\times5$ cm$^2$, the maximum resistance is about $10^5\Omega$/cm$^2$ or less. However, it is preferred for the above-described electrically conductive layer to not cause fog to occur and to not accelerate the formation of fog in the image recording layer, upon heat development of the above-described recording layer. The electrically conductive layer can be transparent or opaque in the present invention. Examples of materials which form transparent electrically conductive layers include tin (IV) oxide, indium (III) oxide, and the like; examples of materials which form semitransparent electrically conductive layers are evaporated chromium, gold and the like; and examples of materials which form opaque electrically conductive layers include chromium, aluminum, nickel and the like. The term "transparent" as used herein is intended to mean the transmission of near ultraviolet light and visible light (wavelength range of about 300 nm to about 700 nm) to an extent of 45% or more, preferably about 65% or more. The term "opaque" as used herein likewise refers to the transmission of about 3% or less, preferably about 1% or less of light in the same wavelength range of about 300 to about 700 nm. The term "semitransparent" as used herein refers to the transmission of light of the above-described wavelength range to an extent ranging between the above-described values.

The electric current conductive composition layer used in the specific examples of the present invention can contain addenda commonly employed in thermographic and photothermographic elements, e.g., in an amount of less than about 5% by weight, preferably less than 2% by weight. Addenda which can be additionally employed in the electric current conductive composition layer useful in the practice of the present invention include toners as disclosed in U.S. Pat. No. 3,672,904 and U.S. Pat. No. 3,801,321, plasticizers and/or lubricants, surfactants, matting agents, brightening agents, light absorbing materials, filter dyes and the like.

The various components in the electric current conductive composition layer used in the present invention can be coated on a support by mixing such components with aqueous solutions or suitable organic solvent solutions, or dispersing such components in binders (e.g., polyvinyl butyral), depending upon the particular properties thereof and then coating the mixture thereof on a support. The components can be added to the coating composition using various procedures known in the photographic art. Suitable solvents for preparing a coating solution must at least be capable of dissolving therein the binder employed and can be appropriately selected depending upon the binder employed. Suitable examples of such solvents include water and organic solvents, e.g., a lower alkanol such as methanol, ethanol, 2-propanol, t-butyl alcohol, etc.; a ketone such as acetone, methyl ethyl ketone, etc.; a liquid hydrocarbon; a chlorinated hydrocarbon such as chloroform, ethylene chloride, carbon tetrachloride, etc.; acetonitrile; dimethylsulfoxide; dimethylformamide and the like. These solvents can be used individually or as a mixture thereof.

The transmission optical density of the image recording layer of the image recording element in accordance with the present invention to visible light should be adjusted, regardless of the thickness of the layer, to about 1.3 or less, preferably about 0.3 or less. Where the transmission optical density is greater than the value described above, the difference in optical density between the images and the background thereof, that is, the contrast, becomes poor so that the images are not discernible, in this case, the element in accordance with the present invention cannot be employed in practical use. On the other hand, a suitable range for the transmission optical density of the image recording layer to electromagnetic waves of a wavelength of about 400 nm or less is smaller than the value above-defined, but no problems occur if the transmission optical density is greater than the value described above.

The image recording layer (electric current conductive composition layer) of the image recording element of the present invention can be coated by using various coating techniques known in the photographic art including dip coating, air knife coating, curtain coating or extrusion coating using hoppers of the type described in U.S. Pat. No. 2,681,294. If desired, two or more layers can be coated simultaneously using procedures known in the art.

An especially useful heat developable image recording element comprises an electrically conductive support having thereon at least one layer comprising an electric current conductive composition, the layer comprising (i) a silver salt of a nitrogen-containing heterocyclic compound such as a silver salt of benzotriazole or a silver salt of a long chain aliphatic acid such as silver behenate, (ii) a reducing agent capable of reducing the above-described silver salt, and (iii) benzotriazole.

The lack of sensitivity of the image recording element to visible light allows it to be handled under normal room illumination; and with the appropriate choice of photoconductive material or photoconductor (for example, a photoelectric sensor), the image recording element has the ability to record images from a wide spectrum of different forms of actinic radiation.

A photoelectric sensor comprises a layer of a material which becomes photoconductive upon irradiation with electromagnetic waves having a wavelength of less than about 20 $\mu$m, or a layer containing such a material, and an electric current conductive layer provided adjacent thereto which is formed from, for example, $In_2O_3$, $SnO_2$, Au, Ag, Pt, Pb or the like, and if desired, both layers can be provided on a support such as a glass plate, a quartz plate, a synthetic resin film and the like. Suitable examples of photoconductive materials which can be used include $\beta$-$Ag_2S$, $Cu_2O$, CuI, ZnO, ZnS, ZnSe, CdS, CdSe, PbS, $Sb_2S_3$, $Bi_2S_3$, $In_2Te_3$, GeS, GeSe, $Tl_2S$, GaAs, PbO, InP, Si, Ge and the like. A layer of such a material can be formed alone or the material can be dispersed into a binder. In the former case, a thin film can be formed by vacuum evaporation, ion plating, sputtering and the like. In the latter case, a conventionally used coating method can be employed.

In order to improve the photoconductive property, a trace amount of a foreign material can be incorporated in the photoconductive material in the photoelectric sensor. Suitable examples of foreign materials which can be incorporated in the photoconductive material in the photoelectric sensor in a trace amount include an element belonging to Group (I) of the Periodic Table, such as Ag (I), Cu (I), etc. When the photoconductive material is a compound belonging to Groups (II)-(IV) of the Periodic Table, such as ZnS, CdS, CdTe, etc., a suitable thickness of the layer containing the photoconductive material can range from about 30 nm to about 10 mm.

The overall heating of the image recording element in accordance with the present invention can be accomplished in a variety of known ways, for example, by placing the image recording element on a heated plate, by passing the image recording element between heated rollers, or by applying radiant energy, e.g., from heating lamps, microwave devices, ultrasonic devices, etc., to the image recording element. Further, although the processing is not a dry processing, the heating can be accomplished by immersing the image recording element in a heated substantially inert liquid or a liquid mixture while it is not a dry type, or applying the heated liquid mentioned above to the image recording element by coating, spraying, or the like. A useful temperature for producing the desired developed images is typically within the range of about 80 to about 250° C., e.g., about 100 to about 160° C. The optimum range will depend on several factors such as the desired image, the components of the particular image recording element, etc.

The time required for the overall heating generally ranges from about 0.1 to about 120 seconds depending upon the particular image recording element, and more importantly, the type of heating device employed. Heating is generally accomplished under atmospheric pressure, but, a pressure above or below atmospheric pressure may be used, if desired. When the image recording element is heated, the metal compound and the reducing agent react in the image areas, thus reducing the metal compound to the corresponding free metal. The thus-produced free metal provides a visible reproduction of the applied electric current, i.e., renders the images visible. In this case, the applied electric current varies in intensity depending on the charge density produced in the image recording element.

Referring now to the drawings, the present invention is explained in detail.

Figure 1B:
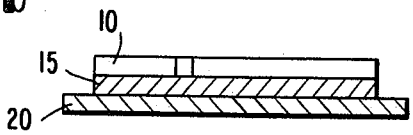

Referring particularly to FIG. 1*a* and FIG. 1*b*, one embodiment of the image recording process of the present invention is shown. In this embodiment, an image recording layer 10 is placed upon a grounded electrically conducting backing or support plate 15. A current is selectively applied from the electric current source 17 to the image recording layer 10 using the point of a metal stylus 16, which is brought into moving contact with the exposed surface of the image recording layer 10. Upon contacting the recording layer with the stylus 16, a current flows in the areas of the image recording layer contacted by the stylus and forms a developable pattern of latent images thereon. The charge density produced by the stylus in the contacted areas of the image recording layer need not be sufficient to produce a visible change in the image recording layer 10. However, the charge density is sufficient to produce a latent image in the image recording layer in those areas contacted by the stylus. Although one specific technique to produce an image-wise electric current flow through the image recording layer 10 has been described, techniques generally known to the art can be used and are intended to be encompassed herein. These known techniques include, for example, contacting the image recording layer 10 with a stencil and scanning the layer 10 with a beam of electrons.

Figure 2A:
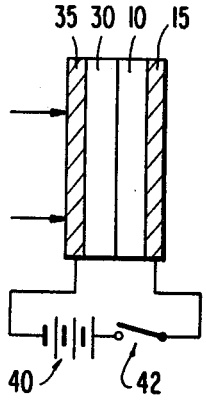
FIG. 2*a* and FIG. 2*b* are outlines of another embodiment of the process for recording an image in accordance with the present invention.
Figure 2B:
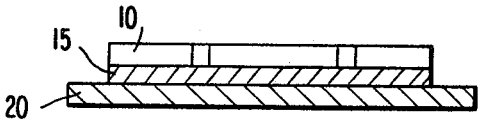

Another embodiment of the present invention is shown in FIG. 2*a* and FIG. 2*b*. In this embodiment, the latent image is formed by sandwiching an image recording layer 10 and a light-to-electron converter element 30, preferably a photoconductive layer (photoelectric sensor layer) 30, between a pair of electrically conductive backings 15 and 35, respectively. An electric field is established across the photoconductive layer (photoelectric sensor layer) and the image recording layers by connecting the electrically conductive backings 15 and 35 to a direct current voltage electric source 40. Advantageously, a photoconductive layer (photoelectric sensor layer) 30 is selected so that, at the operative voltages of the present invention, the relative impedances of the image recording layer 10 and photoconductive layer (photoelectric sensor layer) 30 are within a preferred range.

An electric field across these layers is generated by applying a voltage using a switch 42. The formation of a latent image is effected by image-wise exposing the photoconductive layer (photoelectric sensor layer) to actinic radiation through the transparent conductor (the term "actinic radiation" as used herein refers to the combination of visible light having a wavelength of about 400 nm to about 700 nm and electromagnetic waves having a wavelength of about 400 nm or less). If a support is transparent, it is also possible for the image-wise exposure to be through the support. Such image-wise exposure serves to selectively increase the conductivity of the photoconductive layer (photoelectric sensor layer) in those regions exposed to the actinic radiation. Therefore, an image-wise current flow can be produced through the image recording layer by the image-wise exposure. Upon the completion of the image-wise exposure, the potential is removed; the image recording element is then moved out of contact with the photoconductive layer (photoelectric sensor layer) and substantially uniformly heated to render the latent image in the image recording layer visible. After the latent image is rendered visible upon heating, the heating of the image recording element is stopped.

As described above, the electric current conductive compositions, the image recording elements using such and the process for producing an image employing the image recording elements of this invention are quite advantageous.

More specifically, the electric current conductive composition consisting of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, and a substantially electrically insulating binder, basically a simple 2-component system, is not known until now to be capable of conducting an electric current. Such a composition can, for example, be used per se as an electrically conductive protective coating or an electrically conductive backing layer of a photographic material and an electrophotographic material thereby increasing the ability to prevent generation of static electricity.

Further, the electric current conductive composition of this invention consisting essentially of at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, substantially electrically insulating binder and a reducible metal compound is stable for a long period of time. When such is used in an image recording element comprising a layer of the electric current conductive composition and an electrically conductive layer, or in an image recording element comprising a first electric conductive layer, a layer of the electric current conductive composition, a photoconductive material layer and a second electrically conductive layer, in this order, with at least one of the electrically conductive layers being transparent to actinic radiation, an image having a maximum optical density of about 0.3 to about 0.5 can be obtained simply by passing an electric current therethrough. Even though such an image has low sensitivity since there is no amplification nor intensification effect in the image forming mechanism, this type of image recording element is sufficiently practical for use where an image recording element which records simply information in a "on-off" condition is employed.

These advantages are in addition to those described hereinbefore for the electric conductive compositions of this invention, image recording elements containing such and processes for producing images utilizing such.

The present invention will be explained in detail below with reference to examples thereof, but the present invention is not to be construed as being limited thereto. Unless otherwise indicated, all parts, percents, ratios and the like are by weight. cl EXAMPLE 1

Onto a transparent support (resistance value: 1.2 kΩ/cm$^2$) of a polyethylene terephthalate film having evaporated thereon indium (III) oxide as an electrically conductive layer, there was coated an ethanol solution of polyvinyl butyral (PVB) in which benzotriazole had been dissolved, in a definite layer thickness (5 μm). The coated element was cut into a rectangular shape of 3.5 cm×4.5 cm. The periphery thereof was insulated with an electrically insulating tape to form an area of 10 cm$^2$ of the coated element. A second piece of a polyethylene terephthalate film having an indium (III) oxide electrically conductive layer thereon produced as described above was cut into a rectangular shape of 3.5 cm×4.5 cm, the electrically conductive layer side of which was placed in face-to-face contact with the polyvinyl butyral/benzotriazole layer coated surface of the coated element. Both films were pressed for adherence with a roller. The thus-obtained sample was sufficiently closely contacted. A voltage was applied between the two electrically conductive layers; the electric current flow produced thereby was measured to determine the resistance. The results obtained are shown in Table 1 below.

TABLE 1

| Benzotriazole/PVB Weight Ratio | Electric Resistance (Ω) |
|---|---|
| 0 (PVB alone) | $5 \times 10^9$ |
| 0.1 | $5 \times 10^7$ |
| 0.25 | $8 \times 10^6$ |
| 0.5 | $9 \times 10^5$ |
| 1.0 | $8 \times 10^5$ |
| 2.5 | $8 \times 10^5$ |
| 5.0 | $5 \times 10^5$ |

EXAMPLE 2

In 100 ml of isoamyl acetate was dissolved 6 g of benzotriazole at 50° C. The solution was cooled to −15° C. To the solution, with agitation, was added a solution of 8.5 g of silver nitrate in 100 ml of a dilute aqueous nitric acid solution adjusted to a pH of 2.0 (25° C.) with nitric acid, the silver nitrate solution being previously maintained at 3° C. A dispersion containing microcrystalline benzotriazole silver salt was thus obtained.

(When in place of isoamyl acetate, oils such as butyl acetate, diethyl sebacate, dibutyl phthalate, tricresyl phosphate, etc., were used, similar results were obtained.)

The aqueous layer was first removed and further 400 ml of water was added to wash the system by decantation. Then, 400 ml of methanol was added and the resulting dispersion was centrifuged to obtain the silver salt of benzotriazole. 8 g of the silver salt of benzotriazole was obtained. The crystals of the silver salt of benzotriazole had a long axis of about 1 μm. To 40 ml of an ethyl alcohol solution containing 4 g of polyvinyl butyral was added 5.0 g of the silver salt of benzotriazole thus obtained. After 9.5 g of the benzotriazole was further added thereto, the mixture was dispersed using a ball mill for an hour to prepare a polymer dispersion of the silver salt. To 45 g of the polymer dispersion of the silver salt was added 1.5 g of L-ascorbic acid (reducing agent) at 50° C. to prepare a coating solution. The coating solution was coated onto a support as described in Example 1 in a thickness of 3 g of the silver salt per m$^2$ of the support, to prepare an image recording element.

(Ethyl cellulose, polyvinyl acetate, cellulose acetate, cellulose acetate butyrate, and the like can also be used instead of the polyvinyl butyral used above.)

Then, in order to prepare a photoconductive layer (photoelectric sensor layer), zinc oxide (Sagex 2000, trade name, made by Sakai Kagaku Co., Ltd.) and an acryl type resin varnish (40 wt% total solids content) were mixed in a weight ratio of 80:20. Using toluene as a solvent, the mixture was dispersed therein with a roll mill. The resulting coating liquid was coated on the support as described in Example 1 in a thickness of 3 μm to prepare a photoconductor (photoelectric sensor).

The photoconductive layer (photoelectric sensor layer) was placed in face-to-face contact with the image recording layer, which was pressed using a roller to ensure close contact. A voltage of 5 V was applied between the two indium oxide layers by positively charging the photoconductor and the film was exposed to a super high pressure mercury arc lamp for 30 seconds from the image recording layer side through a negative original. After exposure, the voltage was reduced to zero. The photoconductor was separated from the image recording element. The image-recording element was heated at 130° C. for 10 seconds. The exposed areas were black so that a good nega-posi image was obtained.

EXAMPLE 3

Similar procedures as in Example 2 were carried out by applying a voltage of 5 V with a positive charge to the image recording element side as in Example 2. A good nega-posi image was obtained as in Example 2.

EXAMPLE 4

Using a single crystal (produced using the procedures in E.L. Wolf, *Journal of Photographic Science,* Vol. 2, pages 2–7 (1974) of monovalent copper ion-doped cadmium sulfide as a photoconductor (photoelectric sensor), procedures similar to Example 2 were carried out. Under conditions of an applied voltage of 6.3 V and an exposure for 60 seconds, a good nega-posi image was obtained.

EXAMPLE 5

In a manner similar to Example 2, 45 g of a polymer dispersion of a silver salt of benzotriazole was prepared. To the dispersion were added 1.5 ml of a 8.5 wt% methanol solution of cadmium iodide (silver halide forming component) and 2 g of ascorbic acid monopalmitate to prepare a coating liquid. Thereafter, a good nega-posi image was obtained using procedures as described in Example 2.

EXAMPLE 6

In 100 ml of benzene was dissolved 3.4 g of behenic acid at 60° C. The solution was maintained at 60° C. To the solution was added 100 ml of water while agitating with a stirrer to thereby emulsify. Then, an aqueous solution (at 10° C.) which was obtained by adding aqueous ammonia to about 80 ml of an aqueous solution containing 1.7 g of silver nitrate to form a silver ammonium complex was then added thereto and subsequently water was added thereto to make the total volume 100 ml.

Microcrystalline silver behenate was thus obtained. This mixture was allowed to stand at normal temperature (25° C.) for 20 minutes and an aqueous phase and a benzene phase separated. The aqueous phase was first removed. By adding 400 ml of fresh water to the benzene phase, the benzene phase was washed by decantation. Then 400 ml of methanol was added thereto and silver behenate was removed by centrifugal separation. Thus, 4 g of spindle-like silver behenate crystals having a length of about 1 μm and a width of about 0.05 μm was obtained.

(In place of the benzene used above, toluene, xylene, pentyl acetate, isoamyl acetate or the like can also be used and silver behenate can be obtained in a similar manner).

In 20 ml of an ethanol solution containing 2.5 g of polyvinyl butyral and 7 g of benzotriazole was dispersed 2.3 g (about 1/200 mol) of the silver behenate thus obtained for an hour using a ball mill. (When methanol, propanol and isopropanol are used in place of the ethanol used above, respectively, similar results are obtained).

To the polymer dispersion of the silver salt were added the following components at 50° C., each at 5 minute intervals, in order to produce a coating composition.

| | |
|---|---|
| (a) 2,2'-Methylenebis(6-t-butyl-4-methylphenol) (reducing agent) (25 wt % acetone solution) | 3 ml |
| (b) Phthalazone (color toning agent) (2.5 wt % methyl Cellosolve solution) | 3 ml |

The thus prepared coating solution was coated onto the same kind of support as described in Example 1 in a silver amount of 1 g/m$^2$, and the procedures as described in Example 2 were carried out. A black image was obtained at the exposed areas.

EXAMPLE 7

The potential of the image recording element obtained in accordance with Example 2 was maintained at a voltage of 20 V, positive with respect to a metal stylus (as an electrode). The grounded metal stylus was brought into contact with the electrical current conductive composition layer side and the stylus was moved across the surface of the electrical current conductive composition layer at the rate of about 15 cm/sec. Then, the element was uniformly heated at 130° C. for 10 sec. An image thus appeared in those areas contacted by the grounded stylus.

While the invention has been described in detail and with reference to specific embodiments thereof, it will be apparent to one skilled in the art that various changes and modifications can be made therein without departing from the spirit and scope thereof.

What is claimed is:

1. A process for producing an image by passing an electric current through an image recording element comprising (A) a layer of an electric current conductive composition consisting essentially of (a) at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, (b) a substantially electrically insulating binder, (c) a reducible metal compound and (d) reducing agent for said reducible metal compound and (B) an electrically conductive layer, said process comprising:

(I) producing an image-wise distribution of an electric current in said layer of said electric current conductive composition (A), and (II) heating at least said layer of said electric current conductive composition (A) to produce a visible image at the areas where said electric current passed through said layer of said electric current conductive composition (A), wherein said component (a) is present in an amount effective to render said layer containing said substantially electrically insulating binder electric current conductive by reducing the specific resistance of said binder.

2. The process of claim 1, wherein (a) is benzotriazole.

3. The process of claim 1, wherein said image recording element additionally includes (C), a support and said electrically conductive layer (A) is present on said support (C).

4. The process of claim 1, wherein said substantially electrically insulating binder (b) is gelatin, a gelatin derivative, a polycarbonate, polyvinyl butyral, cellulose acetate, cellulose acetate butyrate, poly(methyl methacrylate), poly(methyl acrylate), polyvinyl pyrrolidone, ethyl cellulose, polystyrene, a butadiene-styrene copolymer, polyvinyl chloride, a chlorinated rubber, a vinyl chloride-vinyl acetate copolymer, a vinyl acetate-vinyl chloride-maleic acid copolymer, polyvinyl alcohol, chlorinated polyethylene or chlorinated polypropylene.

5. The process of claim 1, wherein said substantially electrically insulating binder (b) is polyvinyl butyral.

6. The process of claim 1, wherein said substantially electrically insulating binder (b) is gelatin.

7. The process of claim 1, wherein said reducible metal compound (c) is a silver salt of an organic compound.

8. The process of claim 1, wherein said reducible metal compound (c) is a silver salt of a benzotriazole.

9. The process of claim 1, wherein the transmission optical density to visible light of said layer of said electric current conductive composition (A) is not greater than about 0.5.

10. An image recording element comprising (i) a first electrically conductive layer, (ii) a layer of an electric current conductive composition consisting essentially of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, (b) a substantially electrically insulating binder, (c) a reducible metal compound and (d) a reducing agent for said reducible metal compound, (iii) a photoconductive material layer and (iv) a second electrically conductive layer, in this order, with at least one of said electrically conductive layers ((i) and/or (iv)) being transparent to actinic irradiation, wherein said component (a) is present in an amount efffective to render said layer containing said substantially electrically insulating binder electric current conductive by reducing the specific resistance of said binder, whereby a latent image can be formed in said layer of electric current conductive composition upon production of an image-wise distribution of an electric current therein.

11. The image recording element of claim 10, wherein (a) is benzotriazole.

12. The image recording element of claim 10, wherein said image recording element additionally includes (v) a support and said first electrically conductive layer (i) is present on said support (v).

13. The image recording element of claim 10, wherein said second electrically conductive layer (iv) is transparent to actinic radiation.

14. The image recording element of claim 12, wherein said support (v) is transparent to actinic radiation.

15. The image recording element of claim 10, wherein said substantially electrically insulating binder (b) is gelatin, a gelatin derivative, a polycarbonate, polyvinyl butyral, cellulose acetate, cellulose acetate butyrate, poly(methyl methacrylate), poly(methyl acrylate), polyvinyl pyrrolidone, ethyl cellulose, polystyrene, a butadiene-styrene copolymer, polyvinyl chloride, a chlorinated rubber, a vinyl chloride-vinyl acetate copolymer, a vinyl acetate-vinyl chloride-maleic acid copolymer, polyvinyl alcohol, chlorinated polyethylene or chlorinated polypropylene.

16. The image recording element of claim 10, wherein said substantially electrically insulating binder (b) is polyvinyl butyral.

17. The image recording element of claim 10, wherein said substantially electrically insulating binder (b) is gelatin.

18. The image recording element of claim 10, wherein said reducible metal compound (c) is a silver salt of an organic compound.

19. The image recording element of claim 10, wherein said reducible metal compound (c) is a silver salt of a benzotriazole.

20. The image recording element of claim 10, wherein said substantially electrically insulating binder (b) is gelatin, a gelatin derivative, a polycarbonate, polyvinyl butyral, cellulose acetate, cellulose acetate butyrate, poly(methyl methacrylate), poly(methyl acrylate), polyvinyl pyrrolidone, ethyl cellulose, polystyrene, a butadiene-styrene copolymer, polyvinyl chloride, a chlorinated rubber, a vinyl chloride-vinyl acetate copolymer, a vinyl acetate-vinyl chloride-maleic acid copolymer, polyvinyl alcohol, chlorinated polyethylene or chlorinated polypropylene.

21. An image recording element comprising (A) a layer of an electric current conductive composition consisting essentially of (a) at least one member selected from the group consisting of benzotriazole, nitrobenzotriazole, an alkylbenzotriazole in which the alkyl moiety thereof has up to about 20 carbon atoms, a halobenzotriazole and an amidobenzotriazole in which the amido moiety thereof has up to about 20 carbon atoms, (b) a substantially electrically insulating binder, (c) a reducible metal compound and (d) a reducing agent for said reducible metal compound, and (B) an electrically conductive layer if use for obtaining an image having a size of $5\times5$ cm$^2$, having a maximum resistance of about $10^5\Omega/cm^2$ or less, wherein said component (a) is present in an amount of 0.01 to 30 parts by weight per part by weight of said compound (b) effective to render said layer containing said substantially electrically insulating binder electric current conductive by reducing the specific resistance of said binder, whereby a latent image can be formed in said layer of electric current conductive composition upon production of an image-wise distribution of an electric current therein.

22. The image recording element of claim 21, wherein (a) is benzotriazole.

23. The image recording element of claim 21, wherein said image recording element additionally includes (C) a support and said electrically conductive layer (B) is present on said support (C).

24. The image recording element of claim 21, wherein said substantially electrically insulating binder (b) is gelatin, a gelatin derivative, a polycarbonate, polyvinyl butyral, cellulose acetate, cellulose acetate butyrate, poly(methyl methacrylate), poly(methyl acrylate), polyvinyl pyrrolidone, ethyl cellulose, polystyrene, a butadiene-styrene copolymer, polyvinyl chloride, a chlorinated rubber, a vinyl chloride-vinyl acetate copolymer, a vinyl acetate-vinyl chloride-maleic acid copolymer, polyvinyl alcohol, chlorinated polyethylene or chlorinated polypropylene.

25. The image recording element of claim 21, wherein said substantially electrically insulating binder (b) is polyvinyl butyral.

26. The image recording element of claim 21, wherein said substantially electrically insulating binder (b) is gelatin.

27. The image recording element of claim 21, wherein said reducible metal compound (c) is a silver salt of an organic compound.

28. The image recording element of claim 21, wherein said reducible metal compound (c) is a silver salt of a benzotriazole.

29. The image recording element of claim 21, wherein the transmission optical density to visible light of said layer of said electric current conductive composition (A) is not greater than about 0.5.

30. A process for recording an image by passing an electric current through an image recording element comprising (i) a first electrically conductive composition consisting essentially of (a) at least one member selected from the group consisting of benzotriazole, nitrobenzotriazole, an alkylnenzotriazole in which the alkyl moiety thereof has up to about 20 carbon atoms, (b) a substantially electrically insulating binder, (c) a reducible metal compound and (d) a reducing agent for said reducible metal compound, (iii) a photoconductive material layer and (iv) a second electrically conductive layer, in this order, with at least one of said electrically conductive layers (i) and/or (iv) being transparent to actinic radiation, said process comprising:

(I) image-wise irradiating said photoconductive material layer (iii) using actinic radiation through said electrically conductive layer (i) and/or (iv) transparent to actinic irradiation while simultaneously applying a voltage to said first electrically conductive layer (i) and said second electrically conductive layer (iv) to pass an electric current through said layer of said electric current conductive composition (ii), and (II) heating at least said layer of said electric current conductive composition (ii) to produce a visible image at areas where said electric current passed through said layer of said electric current conductive composition (ii), wherein said component (a) is present in an amount effective to render said layer containing said substantially electrically insulating binder electric current conductive by reducing the specific resistance of said binder.

31. The process of claim 30, wherein (a) is benzotriazole.

32. The process of claim 30, wherein said image recording element additionally includes (v) a support and said first electrically conductive layer (i) is present on said support (v).

33. The process of claim 32, wherein said support (v) is transparent to actinic radiation.

34. The process of claim 30, wherein said second electrically conductive layer (iv) is transparent to actinic radiation.

35. The process of claim 30, wherein said substantially electrically insulating binder (b) is gelatin, a gelatin derivative, a polycarbonate, polyvinyl butyral, cellulose acetate, cellulose acetate butyrate, poly(methyl methacrylate), poly(methyl acrylate), polyvinyl pyrrolidone, ethyl cellulose, polystyrene, a butadiene-styrene copolymer, polyvinyl chloride, a chlorinated rubber, a vinyl chloride-vinyl acetate copolymer, a vinyl acetate-vinyl chloride-maleic acid copolymer, polyvinyl alcohol, chlorinated polyethylene or chlorinated polypropylene.

36. The process of claim 30, wherein said substantially electrically insulating binder (b) is polyvinyl butyral.

37. The process of claim 30, wherein said substantially electrically insulating binder (b) is gelatin.

38. The process of claim 30, wherein said reducible metal compound (c) is a silver salt of an organic compound.

39. The process of claim 30, wherein said reducible metal compound (c) is a silver salt of a benzotriazole.

40. The process of claim 30, wherein the transmission optical density to visible light of said layer of said electric current conductive composition (ii) is not greater than about 0.5.

41. The image recording element of claim 21, wherein the amount of component (a) is from about 0.1 to about 10 parts by weight per part by weight of the binder.

42. The image recording element of claim 21, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

43. The image recording element of claim 41, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

44. The image recording element of claim 10, wherein the amount of component (a) is from about 0.01 to about 30 parts by weight per part by weight of the binder.

45. The image recording element of claim 10, wherein the amount of component (a) is from about 0.1 to about 10 parts by weight per part by weight of the binder.

46. The image recording element of claim 43, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

47. The image recording element of claim 44, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

48. The process of claim 1, wherein the amount of component (a) is from about 0.01 to about 30 parts by weight per part by weight of the binder.

49. The process of claim 1, wherein the amount of component (a) is from about 0.1 to about 10 parts by weight per part by weight of the binder.

50. The process of claim 1, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

51. The process of claim 48, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

52. The process of claim 30, wherein the amount of component (a) is from about 0.01 to about 30 parts by weight per part by weight of the binder.

53. The process of claim 30, wherein the amount of component (a) is from about 0.1 to about 10 parts by weight per part by weight of the binder.

54. The process of claim 52, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

55. The process of claim 53, wherein the binder per se has an electrical resistivity of greater than about $10^{14}$ Ω·cm, while the binder plus component (a) has a lowered resistivity of about $10^{9}$ Ω·cm to about $10^{13}$ Ω·cm.

* * * * *